US011839249B1

(12) United States Patent
Heberlein

(10) Patent No.: US 11,839,249 B1
(45) Date of Patent: Dec. 12, 2023

(54) GARMENT INCLUDING A REMOVABLE ABSORBENT HOOD LINER

(71) Applicant: Jonie Heberlein, Pocatello, ID (US)

(72) Inventor: Jonie Heberlein, Pocatello, ID (US)

( * ) Notice: Subject to any disclaimer, the term of this patent is extended or adjusted under 35 U.S.C. 154(b) by 102 days.

(21) Appl. No.: 17/459,506

(22) Filed: Aug. 27, 2021

Related U.S. Application Data

(60) Provisional application No. 63/078,653, filed on Sep. 15, 2020.

(51) Int. Cl.
*A41D 31/12* (2019.01)
*A41D 1/00* (2018.01)

(52) U.S. Cl.
CPC ..... *A41D 31/125* (2019.02); *A41D 1/00* (2013.01); *A41D 2200/20* (2013.01)

(58) Field of Classification Search
CPC ..... A41D 31/125; A41D 1/00; A41D 2200/20
See application file for complete search history.

(56) References Cited

U.S. PATENT DOCUMENTS 5,560,043 A * 10/1996 Armstrong ..... A41D 3/00 2/85
6,874,162 B2 * 4/2005 Boezi ..... A41D 15/005 2/84
7,380,286 B1 * 6/2008 Bryant, Sr. ..... A42B 1/048 2/202
8,613,114 B1 * 12/2013 Olivares Velasco ..... A41D 31/065 2/171.1
10,264,839 B2 * 4/2019 Blackwell ..... A42B 1/048
10,455,878 B2 * 10/2019 Rickle ..... F41H 3/00
2004/0187186 A1 * 9/2004 Boezi ..... A41D 15/005 2/84
2006/0288465 A1 * 12/2006 Delorenzo ..... A41D 3/005 2/84
2007/0118960 A1 * 5/2007 Goodwin ..... A41D 1/04 2/84
2014/0237700 A1 * 8/2014 Albert ..... A41D 15/04 2/84
2015/0013046 A1 * 1/2015 Coleman ..... A42B 1/048 2/202
2016/0316836 A1 * 11/2016 Kelley ..... A41D 27/08
2017/0119076 A1 * 5/2017 Marji ..... A42B 1/048
2018/0027889 A1 * 2/2018 Frost ..... A41D 3/00
2018/0213867 A1 * 8/2018 Vavolotis ..... A41D 31/04
2019/0174853 A1 * 6/2019 Rickle ..... A42B 1/048
2020/0000153 A1 * 1/2020 Curry ..... A41B 1/22
(Continued)

*Primary Examiner* — Khaled Annis
(74) *Attorney, Agent, or Firm* — Hawley Troxell Ennis & Hawley LLP; Philip McKay; Rivkah Young

(57) ABSTRACT

A two-layer hood including an outer hood layer and a detachable absorbent inner hood layer formed to detachably line an inner surface of the two-layer hood. The absorbent inner hood layer is made of absorbent material. Both layers of the two-layer hood can be worn over wearer's head or pulled back like a traditional hooded garment, or "hoodie." However, the outer hood layer of the two-layer hood can also be separately pulled back such that only the absorbent inner hood layer remains on the wearer's head. In this way perspiration can be absorbed by the absorbent inner hood layer while the outer hood layer remains essentially "sweat free." In addition, the absorbent inner hood layer can be removed and used as a supplementary towel and/or washed separately from the parent garment.

20 Claims, 15 Drawing Sheets

(56) References Cited

U.S. PATENT DOCUMENTS

| | | | | |
|---|---|---|---|---|
| 2020/0205554 | A1* | 7/2020 | Deioma | A45F 3/04 |
| 2021/0022415 | A1* | 1/2021 | Curry | A41B 1/22 |
| 2021/0037904 | A1* | 2/2021 | Macfarlane | A42B 1/048 |
| 2021/0059342 | A1* | 3/2021 | Phillips | A41D 1/04 |
| 2021/0145096 | A1* | 5/2021 | Thornton | A41D 27/10 |
| 2021/0345700 | A1* | 11/2021 | Krulik | A47K 5/1211 |

* cited by examiner

GARMENT INCLUDING A REMOVABLE ABSORBENT HOOD LINER

RELATED APPLICATION

This application claims the benefit of Heberlein, U.S. Provisional Patent Application No. 63/078,653, filed on Sep. 15, 2020, entitled "GARMENT WITH HOOD INCLUDING A REMOVABLE ABSORBANT HOOD LINER," which is herein incorporated by reference in its entirety as if it were fully set forth herein.

BACKGROUND

Physical activity related attire, such as fitness attire, is one of the largest industries in the United States, and indeed in the entire word. One of the challenges facing both fitness enthusiasts and physical activity related attire manufacturers is the need to provide physical activity related attire that addresses the issues of perspiration and personal hygiene. To this end, many physical activity related attire manufacturers have historically used various moisture absorbing materials in their products in an effort to draw at least part of a wearer's perspiration away from the wearer's skin. However, these products still suffer from the fact that even when the perspiration is effectively drawn away from the wearers' skin, the perspiration is still just absorbed by the physical activity related attire material which is typically then worn by the user with the absorbed perspiration still in contact with the wearer. In short, the perspiration drawn away from the skin is still contained in the now sweat soaked garment worn by, and therefore in contact with and carried around with, the wearer. Clearly this situation is far from ideal and, at best, simply absorbs the perspiration without addressing the aesthetic, heath, hygiene, and other issues associated with walking around in a sweat soaked garment.

The situation above is unsatisfactory and often unsanitary. This situation is particularly problematic when the wearer is sharing a workout or employment facility such as a gym, dojo, game court/arena, workspace, etc. with others. In these venues, not only is the buildup of perspiration in, or on, clothing unpleasant to others using the facility on aesthetic grounds, but the buildup of perspiration also results in sweat dripping onto machines, weights, floors and other shared equipment and spaces. Clearly this is unsanitary under the best of conditions and can even be dangerous in a world of numerous pathogens and pandemics.

To address these issues, many health and hygiene conscious wearers of prior art physical activity related attire attempt to change out of their physical activity related attire right after, or even during, a workout or activity. However, even so, the wearer still ends up wearing sweat soaked garments throughout most, if not all, of their workout or activity. In some cases, some facilities such as athletic facilities provide supplementary towels or other absorbent items to be used to wipe away perspiration before it can accumulate and soak clothing or drip onto shared equipment. These same towels and the like are also often provided and used to wipe down equipment. However, with today's elevated disease consciousness brought about by a barrage of seeming annual pandemics and routine world travel, many people do not trust that the supplementary towels or other absorbent items provided by these facilities. Consequently, many people have resorted to bringing their own towels or other absorbent items. However, even when towels, whether provided or brought from home, are used to wipe away sweat, there is still often residue sweat left behind on the user, the towels, and any surface wiped with the towel. In addition, this practice does not really address the issue completely because the result is often that the user now not only has sweat soaked athletic garments, but also a sweat soaked towel that must be carried around.

In a fast-paced world where people are often struggling to squeeze in a workout between tasks of the workday, this added inconvenience is not at all welcome. In fact, the inconvenience of having to change into physical activity related attire, workout, change out of physical activity related attire, then carry around the sweat soaked physical activity related attire and perhaps a sweat soaked towel, wash the sweat soaked physical activity related attire and sweat soaked towel each day, pack up the now clean physical activity related attire and towel, and then remember to bring these items for the next day's workout can be simply too complicated and time consuming. As a result, many would be health enthusiasts end up skipping workouts.

The situation discussed above is not limited to athletic attire. Many jobs and activities are also of a physical nature and therefore naturally result in perspiration. Many of these activities also involve the use of activity related attire, e.g., work clothing, that can become sweat soaked. This results in the same issues discussed above. In addition, many types of personal attire, such a sweatshirts, hoodies, etc. also suffer from the above issues when these garments are worn in everyday use in situations where perspiration is generated.

Herein the term "physical activity related attire" and "garment" are used interchangeably and include, but are not limited to, any physical activity related attire, and/or personal attire, and/or work attire, worn by a user/wearer.

The situation described above is far from ideal under normal circumstances. However, as noted, it is has become even more intolerable under current conditions of COVID-19 and other potential pandemics. What is needed is a method and system for providing physical activity related attire with a supplementary absorbent mechanism that is part of the physical activity related attire, yet does not suffer from the inconvenience, aesthetic issues, hygiene issues, and health issues associated with prior at methods and systems as discussed above.

SUMMARY

Embodiments of the present disclosure provide a technical solution to the long-standing technical problem of providing physical activity related attire, e.g., athletic, work, and/or personal attire, with a supplementary absorbent mechanism that is part of the physical activity related attire, yet does not suffer from the inconvenience, aesthetic, hygiene, and health issues associated with prior art methods and systems.

To this end, in one embodiment, an absorbent inner hood layer made of absorbent or wicking material such as terry-cloth, microfiber, or any other absorbent towel-like material is disclosed. In one embodiment, the absorbent inner hood layer is formed to substantially line an inner surface of a parent garment hood and be detachable from the inner surface of the parent garment hood.

When the disclosed absorbent inner hood layer is removable attached as an inner layer to a parent garment hood to form a two-layer hood, the entire two-layer hood, i.e., both inner and outer hood layers, can be worn over wearer's head or pulled back and draped over the wearer's back like a traditional hooded garment, or "hoodie." However, in one embodiment, the outer hood layer of the two-layer hood can be partially detached and separately pulled back such that the absorbent inner hood layer remains on the wearer's head while the outer hood layer is pulled back and draped over the wearer's back. In this way perspiration can be absorbed by the absorbent inner hood layer while the outer hood layer remains essentially "sweat free."

Then, after the workout, or other perspiration inducing action, the absorbent inner hood layer can be removed, along with the absorbed perspiration, while the perspiration free outer hood layer can be used like any other hood. The absorbent inner hood layer can then be washed to remove the absorbed perspiration, without having to wash the entire garment. In addition, in one embodiment, a second absorbent inner hood layer can be used to immediately replace the soiled first absorbent inner hood layer. Either way a clean absorbent inner hood layer can then be attached to the outer hood layer, and the parent garment, to await the next perspiration inducing activity.

Using the disclosed detachable absorbent inner hood layer, a mechanism is provided to absorb, control, and remove perspiration while, at the same time preserving the popular aesthetics of a standard hooded garment such as a hoodie.

In addition, in one embodiment, the disclosed absorbent inner hood layer can be removed before, or during, the perspiration producing physical activity and used as a supplementary towel. In this case, the perspiration can be absorbed by the absorbent inner hood layer, now being used as a towel, while the outer hood layer remains essentially "sweat free." Then, after the workout, or other perspiration inducing action, the absorbent inner hood layer, along with the absorbed perspiration, can then be washed to remove the absorbed perspiration, without having to wash the entire garment. The now clean absorbent inner hood layer can then be reattached to the outer hood layer, and the garment, to be carried around continuously, and without forethought, to await the next perspiration inducing activity.

In addition, when two or more of the disclosed absorbent inner hood layers are utilized, when a first disclosed absorbent inner hood layer becomes soiled the first disclosed absorbent inner hood layer can be detached from the parent garment and replaced with a second disclosed absorbent inner hood layer. In this way, the amount of perspiration capable of being absorbed is effectively doubled. In addition, by utilizing multiple disclosed absorbent inner hood layers, the user can wait multiple days before having to wash the disclosed absorbent inner hood layers. This provides the user the flexibility and freedom to minimize complications to their daily routine.

The disclosed embodiments provide a supplementary absorbent mechanism that is a removable part of the parent garment and yet does not suffer from the inconvenience, aesthetic issues, hygiene issues, and health issues associated with prior art methods and systems. In addition, the disclosed embodiments provide these advantages in the hooded garment, or "hoodie," platform that has become so popular with people of all ages.

A wearer of a garment including the disclosed absorbent inner hood layer is provided a perspiration absorbing mechanism/device that can be used to protect both the wearer and parent garment from perspiration, and/or be used as a supplementary towel like device; without requiring the wearer to remember to bring any additional items. In short, whenever the disclosed absorbent inner hood layer are worn with a parent garment, the wearer always has a towel like absorbent mechanism with them.

Consequently, the disclosed absorbent inner hood layer provides a solution to one of the long-standing challenges facing both fitness enthusiasts and physical activity related attire manufacturers of needing to provide physical activity related attire that addresses the issues of perspiration and personal hygiene. However, the disclosed absorbent inner hood layer can also be used in the workplace, or in any other circumstances where physical activity is likely, and/or perspiration is likely to be induced. This can include, but is not limited to, any casual wear, camping gear, uniforms, work clothes, etc.

In addition, unlike prior art methods and systems, the disclosed absorbent inner hood layer does not leave perspiration-soaked garment in contact with the wearer's skin by remaining in the physical activity related attire. Instead, the disclosed absorbent inner hood layer provides an absorption mechanism that once used to protect the parent garment is detachable from the parent garment. Consequently, using the disclosed absorbent inner hood layer, the perspiration is removed from the user and the parent garment so that the heath, hygiene, and other issues associated with walking around in a sweat soaked garment are eliminated.

The disclosed solution is particularly convenient when the wearer is sharing a workout facility such as a gym, dojo, game court/arena, workplace, etc. with others. In these venues, the buildup of perspiration in, or on, clothing and sweat dripping onto machines, weights, floors and other shared equipment and spaces is completely avoided without having to resort to potentially unsanitary supplementary towels or other absorbent items provided by persons and facilities unknown. This is particularly important given the current elevated disease consciousness and routine world travel.

Finally, by providing a detachable absorbent inner hood layer that can be removed before, or during, the perspiration producing physical activity, the perspiration can be absorbed by the absorbent inner hood layer while the outer hood layer and parent garment remains essentially "sweat free." Consequently, after the workout, or other perspiration inducing action, the absorbent inner hood layer, along with the absorbed perspiration, can then be washed to remove the absorbed perspiration, without having to wash the entire garment. Therefore, less clothing needs to be washed and energy and washing resources are saved.

In one embodiment, a garment is disclosed that includes a two-layer hood. The two-layer hood of the disclosed embodiments includes an outer hood layer, typically made of the same material as the garment itself, and a detachable absorbent inner hood layer that is formed to substantially line an inner surface of the two-layer hood and that is made of absorbent material.

Consequently, in one embodiment, the disclosed garment includes a two-layer hood designed such that the entire hood, i.e., both inner and outer hood layers, can be worn over wearer's head or pulled back and draped over the wearer's back like a traditional hooded garment, or "hoodie." However, in one embodiment, the outer hood layer of the two-layer hood can be separately pulled back such that the absorbent inner hood layer remains on the wearer's head while the outer hood layer is pulled back and draped over the wearer's back. In this way perspiration can be absorbed by the absorbent inner hood layer while the outer hood layer remains essentially "sweat free." Then, after the workout, or other perspiration inducing action, the absorbent inner hood layer can be removed, along with the absorbed perspiration, while the perspiration free outer hood layer can be used like any other hood. The absorbent inner hood layer can then be washed to remove the absorbed perspiration, without having to wash the entire garment. The now clean absorbent inner hood layer can then be reattached to the outer hood layer, and the garment, to be carried around continuously to await the next perspiration inducing activity.

Using the disclosed two-layer hood garment including the disclosed detachable absorbent inner hood layer, a mechanism is provided to absorb, control, and remove perspiration while, at the same time preserving the popular aesthetics of a standard hooded garment such as a hoodie.

In addition, in one embodiment, the absorbent inner hood layer of the disclosed two-layer hood can be removed before, or during, the perspiration producing physical activity and used as a supplementary towel. In this case, the perspiration can be absorbed by the absorbent inner hood layer, now being used as a towel, while the outer hood layer remains essentially "sweat free." Then, after the workout, or other perspiration inducing action, the absorbent inner hood layer, along with the absorbed perspiration, can then be washed to remove the absorbed perspiration, without having to wash the entire garment. The now clean absorbent inner hood layer can then be reattached to the outer hood layer, and the garment, to be carried around continuously, and without forethought, to await the next perspiration inducing activity.

In addition, when two or more of the disclosed absorbent inner hood layers are utilized with the disclosed two-layered hood garment, when a first disclosed absorbent inner hood layer becomes soiled the first disclosed absorbent inner hood layer can be detached from the parent garment and replaced with a second disclosed absorbent inner hood layer. In this way, the amount of perspiration capable of being absorbed is effectively doubled. In addition, by utilizing multiple disclosed absorbent inner hood layers, the user can wait multiple days before having to wash the disclosed absorbent inner hood layers. This provides the user the flexibility and freedom to minimize complications to their daily routine.

The disclosed embodiments provide a garment that includes supplementary absorbent mechanism that is part of the garment and yet does not suffer from the inconvenience, hygiene issues, and health issues associated with prior art methods and systems. In addition, the disclosed embodiments provide these advantages in the hooded garment, or "hoodie," platform that has become so popular with people of all ages.

A wearer of the disclosed garments with two-layered hoods is provided a perspiration absorbing mechanism/device that can be used to protect both the wearer and parent garment from perspiration, and/or be used as a supplementary towel like device; without requiring the wearer to remember to bring any additional items. In short, whenever the disclosed garments with two-layered hoods are worn, the wearer always has a towel like absorbent mechanism with them.

Consequently, disclosed garments with two-layered hoods provide a solution to one of the long-standing challenges facing both fitness enthusiasts and physical activity related attire manufacturers of needing to provide physical activity related attire that addresses the issues of perspiration and personal hygiene. However, the disclosed garments with two-layered hoods can also be used in the workplace, or in any other circumstances where physical activity is likely, and/or perspiration is likely to be induced. This can include, but is not limited to, any casual wear, camping gear, uniforms, work clothes, etc.

In addition, unlike prior art methods and systems, the disclosed garments with two-layered hoods do not use absorbing materials to draw perspiration away from the wearer's skin where the perspiration then remains in the physical activity related attire and in contact with the wearer. Instead, the disclosed garments with two-layered hoods provide an absorption mechanism, i.e., the absorbent inner hood layer, that once used to protect the parent garment is detachable from the parent garment. Consequently, using the disclosed garments with two-layered hoods the perspiration is removed from the user and the parent garment so that the heath, hygiene, and other issues associated with walking around in a sweat soaked garment are eliminated.

The disclosed solution is particularly convenient when the wearer is sharing a workout facility such as a gym, dojo, game court/arena, workplace etc. with others. In these venues, the buildup of perspiration in, or on, clothing and sweat dripping onto machines, weights, floors and other shared equipment and spaces is completely avoided without having to resort to potentially unsanitary supplementary towels or other absorbent items provided by persons and facilities unknown. This is particularly important given the current elevated disease consciousness and routine world travel.

Finally, by providing a detachable absorbent inner hood layer that can be removed before, or during, the perspiration producing physical activity, the perspiration can be absorbed by the absorbent inner hood layer while the outer hood layer and parent garment remains essentially "sweat free." Consequently, after the workout, or other perspiration inducing action, the absorbent inner hood layer, along with the absorbed perspiration, can then be washed to remove the absorbed perspiration, without having to wash the entire garment. Therefore, using the disclosed garments with two-layered hoods, less clothing needs to be washed and energy and washing resources are saved.

BRIEF DESCRIPTION OF THE DRAWINGS

Common reference numerals are used throughout the figures (FIGS.) and the detailed description to indicate like elements. One skilled in the art will readily recognize that the above figures are merely illustrative examples and that other elements/functions can be provided and implemented without departing from the characteristics and features of the invention, as set forth in the claims.

DETAILED DESCRIPTION

Embodiments will now be discussed with reference to the accompanying figures (FIGS.), which depict one or more exemplary embodiments. Embodiments may be implemented in many different forms and should not be construed as limited to the embodiments set forth herein, shown in the figures, or described below. Rather, these exemplary embodiments are provided to allow a complete disclosure that conveys the principles of the invention, as set forth in the claims, to those of skill in the art.

Figure 1:
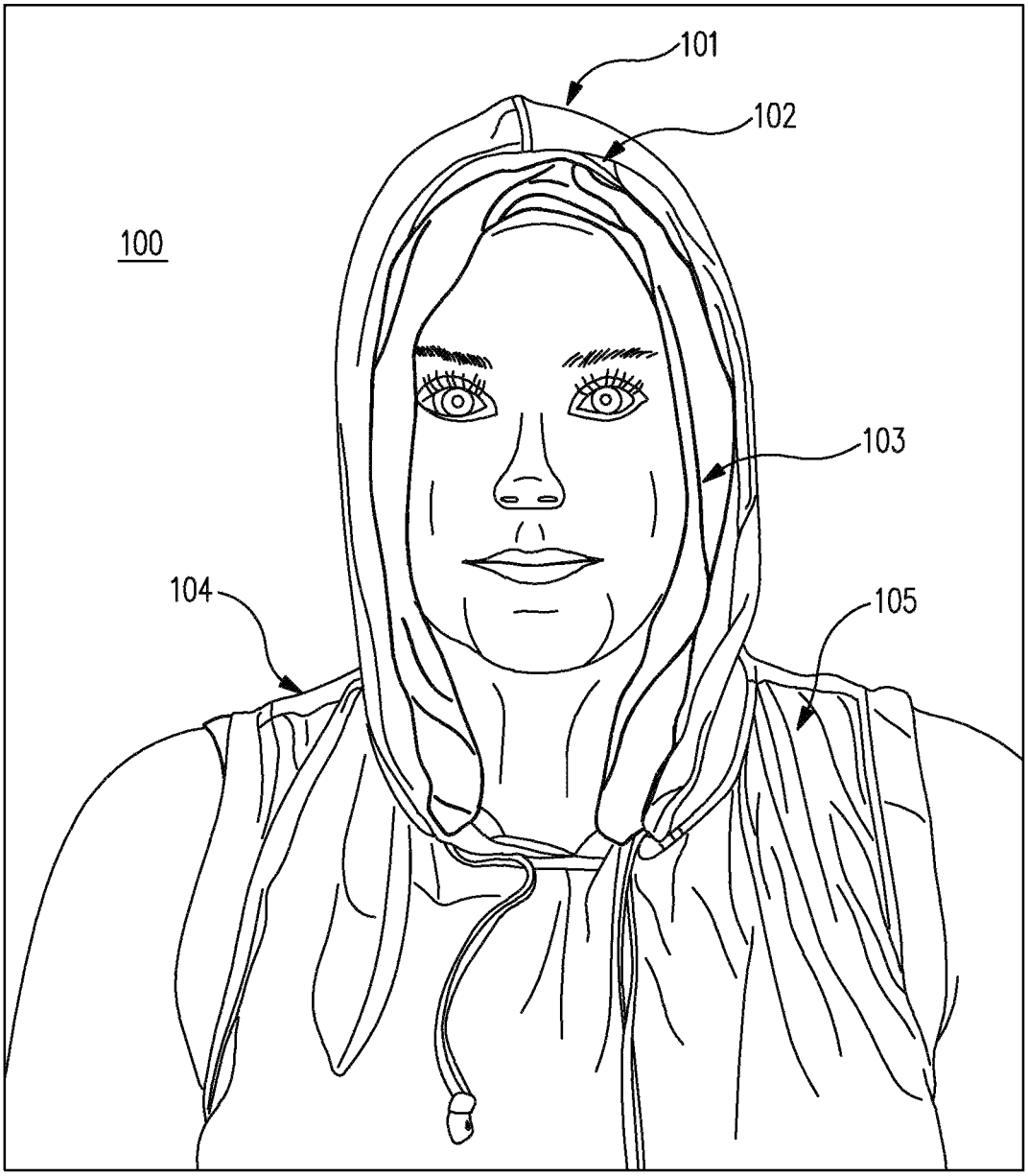
FIG. 1 shows a front view of one embodiment of a disclosed garment with two-layered hood including a two-layered hood with an outer hood layer and the disclosed absorbent inner hood layer.

FIG. 1 shows a front view of one embodiment of a disclosed garment with two-layered hood 100 including a parent garment 104, parent garment front 105, and a two-layered hood 101 with an outer hood layer 102 and disclosed absorbent inner hood layer 103.

As seen in FIG. 1, in this specific illustrative example of one embodiment, garment with two-layered hood 100 includes a parent garment 104 including a parent garment front 105 with permanently attached outer hood layer 102. In various embodiments, parent garment 104 can be athletic attire/apparel, work attire/apparel, hiking and/or running attire/apparel, foul weather attire/apparel, or any other garment/apparel that includes a garment body and hood. In a specific illustrative example, parent garment 104 can be a "hoodie" sweatshirt or any long or short sleeved upper body garment with an attached hood.

In various embodiments, parent garment 104 can be constructed of virtually any material including but not limited to: fleece, cotton, synthetic, blends, or any other material known in the art at the time of filing, and/or as made known after the time of filing. In various embodiments parent garment 104 can be produced from specialty materials such as waterproof materials, sun screening materials, wicking materials, mesh materials, etc. known in the art at the time of filing, and/or as made known after the time of filing.

As seen in FIG. 1, garment with two-layered hood 100 also includes one embodiment of the disclosed absorbent inner hood layer 103. Consequently, according to the disclosed embodiments parent garment 104 includes a two-layered hood 101 with outer hood layer 102 being permanently attached to parent garment 104 and absorbent inner hood layer 103 being removably attached to an inner surface of outer hood layer 102. In this two-layered hood 101 configuration of the disclosed embodiments, outer hood layer 102 can be made of any material, including the same material as parent garment 104 itself.

In various embodiments, detachable absorbent inner hood layer 103 is made of absorbent material, such as terrycloth, microfiber, or any other absorbent towel-like material known in the art at the time of filing, and/or as made known after the time of filing. In addition, absorbent inner hood layer 103 is formed to substantially line an inner surface of two-layered hood 101 and removably reside inside outer hood layer 102.

As seen in FIG. 1, absorbent inner hood layer 103 lies between the head of the wearer and outer hood layer 102 when two-layered hood 101 is worn over the wearer's head.

Consequently, in one embodiment, the disclosed garment with two-layered hood 100 includes a two-layered hood 101 designed such that the entire two-layered hood 101, i.e., both absorbent inner hood layer 103 and outer hood layer 102 can be worn over wearer's head like a traditional hooded garment, or "hoodie." However, as discussed below, in one embodiment, the outer hood layer 102 of the two-layered hood 101 can be separately pulled back such that the absorbent inner hood layer 103 remains on the wearer's head while the outer hood layer 102 is pulled back and draped over the wearer's back.

In this way perspiration can be absorbed by the absorbent inner hood layer 103 while the outer hood layer 102 remains essentially "sweat free." Then, after the workout, or other perspiration inducing action, the absorbent inner hood layer 103 can be removed, along with the absorbed perspiration, while the perspiration free outer hood layer 102 can be used like any other garment hood. The absorbent inner hood layer 103 can then be washed to remove the absorbed perspiration, without having to wash the entire parent garment 104. The now clean absorbent inner hood layer 103 can then be reattached to the outer hood layer 102, and the parent garment 104 garment, to be carried around continuously to await the next perspiration inducing activity.

In some embodiments, two or more of the disclosed absorbent inner hood layers 103 are utilized. In these embodiments, when a first disclosed absorbent inner hood layer 103 becomes soiled the first disclosed absorbent inner hood layer 103 can be detached from the disclosed garment with two-layered hood 100 and replaced with a second disclosed absorbent inner hood layer 103. In this way, the amount of perspiration capable of being absorbed is effectively doubled. In addition, by utilizing multiple disclosed absorbent inner hood layers 103, the user can wait multiple days before having to wash the disclosed absorbent inner hood layers 103. This provides the user the flexibility and freedom to minimize complications to their daily routine.

Figure 2:
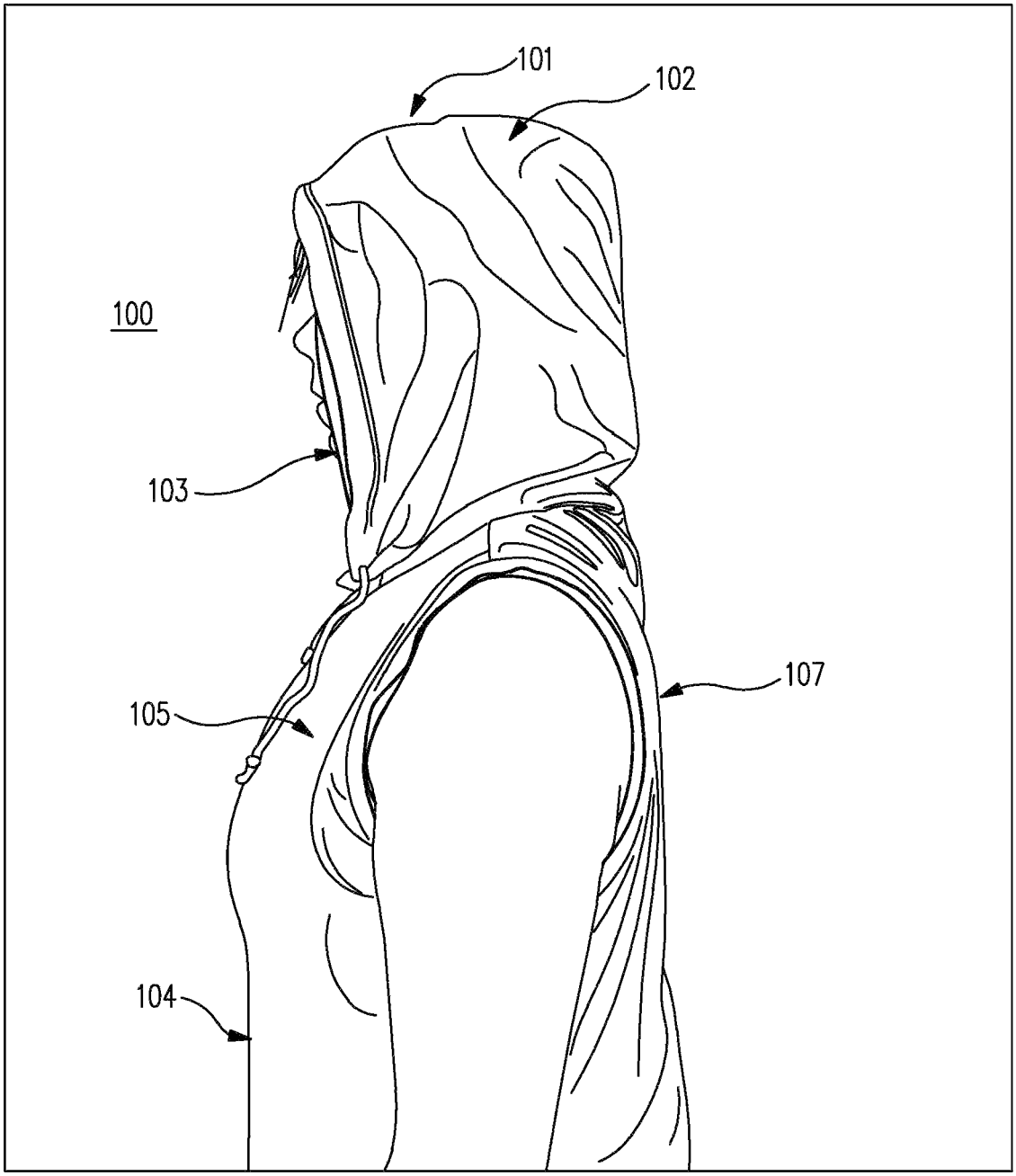
FIG. 2 shows a left side view of one embodiment of a disclosed garment with two-layered hood including a two-layered hood with an outer hood layer and the disclosed absorbent inner hood layer.

FIG. 2 shows a left side view of one embodiment of a disclosed garment with two-layered hood 100 including parent garment 104 with parent garment front 105 and parent garment back 107, and two-layered hood 101 with outer hood layer 102 and absorbent inner hood layer 103.

As seen in FIG. 2, in one embodiment, the addition of the disclosed absorbent inner hood layer 103 does not significantly change the aesthetics and/or function of garment with two-layered hood 100 with respect to prior art hooded garments such as hoodies. Consequently, the desired traditional hoodie look and feel of garment with two-layered hood 100 is not altered by the addition of absorbent inner hood layer 103.

Figure 3:
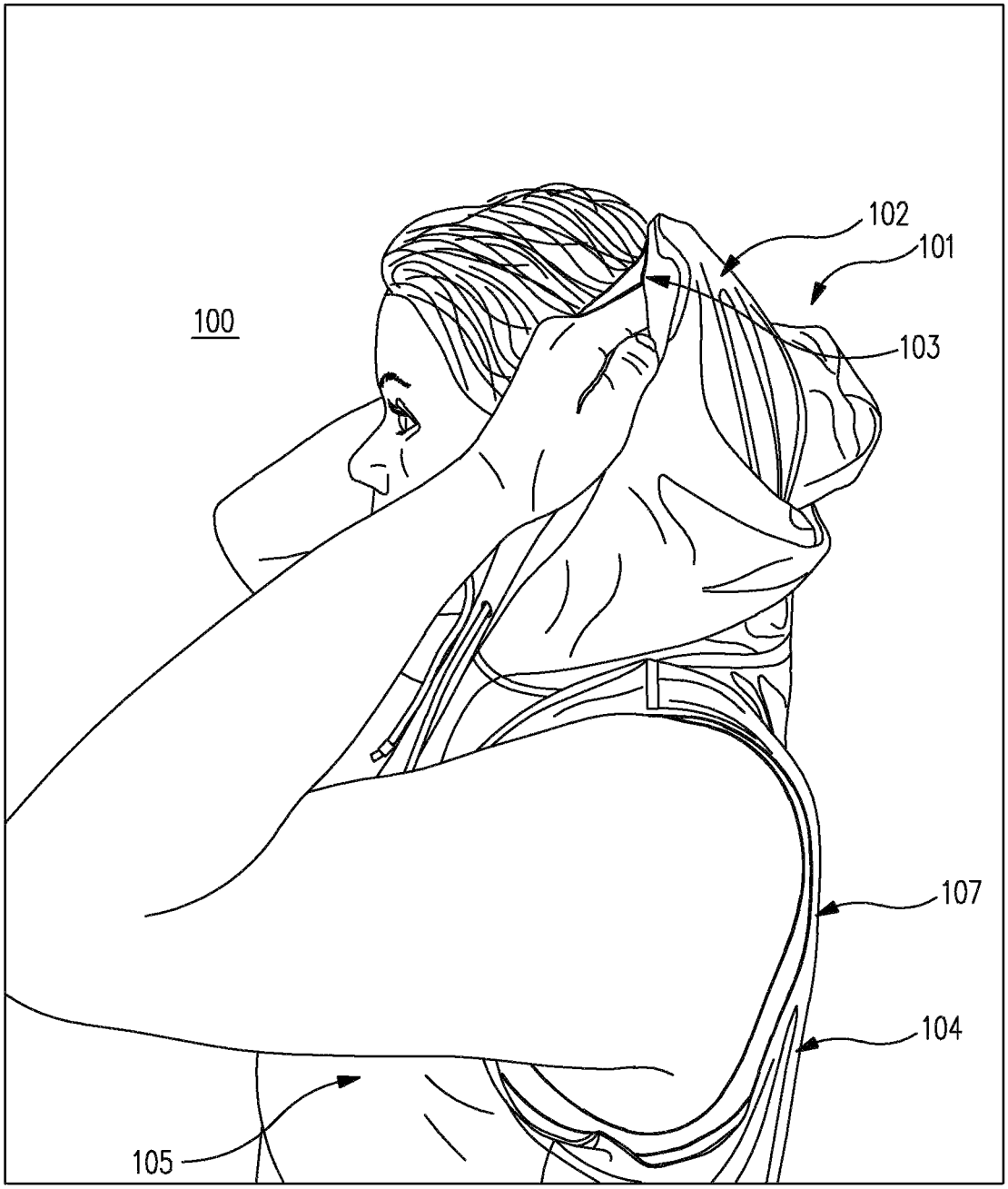
FIG. 3 shows a left side view of one embodiment of a disclosed garment with two-layered hood including both layers of the disclosed two-layered hood partially pulled back off the wearer's head.

FIG. 3 shows a left side view of one embodiment of a disclosed garment with two-layered hood 100 including parent garment 104 with parent garment front 105 and parent garment back 107, two-layered hood 101 including two-layered hood 101 partially pulled back off the wearer's head.

As noted with respect to FIG. 2, and as seen also in FIG. 3, in one embodiment, the addition of the disclosed absorbent inner hood layer 103 does not significantly change the aesthetics and/or function of garment with two-layered hood 100 with respect to prior art hooded garments such as hoodies. Consequently, the desired traditional hoodie look and feel of garment with two-layered hood 100 is not altered by the addition of absorbent inner hood layer 103.

Figure 4:
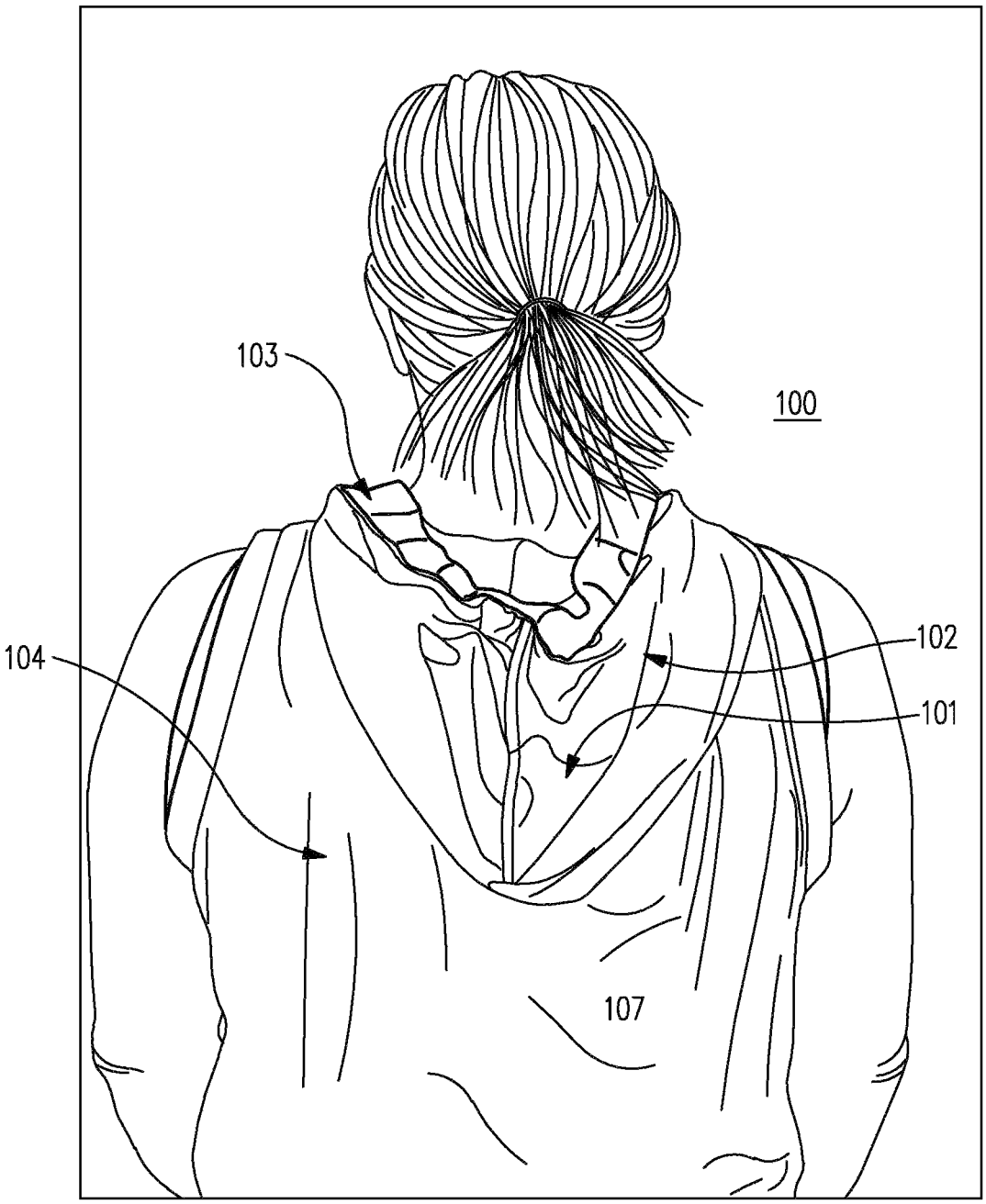
FIG. 4 shows a back view of one embodiment of a disclosed garment with two-layered hood with the two-layered hood, including the outer hood layer and disclosed absorbent inner hood layer, pulled back and draped over the back of the disclosed garment with two-layered hood.

FIG. 4 shows a view of parent garment 104 and parent garment back 107 of one embodiment of a disclosed garment with two-layered hood 100 with two-layered hood 101, including outer hood layer 102 and absorbent inner hood layer 103, both pulled back and draped over parent garment back 107.

Again, as seen in FIG. 4, in one embodiment, the addition of the disclosed absorbent inner hood layer 103 does not significantly change the aesthetics and/or function of garment with two-layered hood 100 with respect to prior art hooded garments such as hoodies. Consequently, desired traditional hoodie look and feel of garment with two-layered hood 100 is not altered by the addition of absorbent inner hood layer 103.

Figure 5:
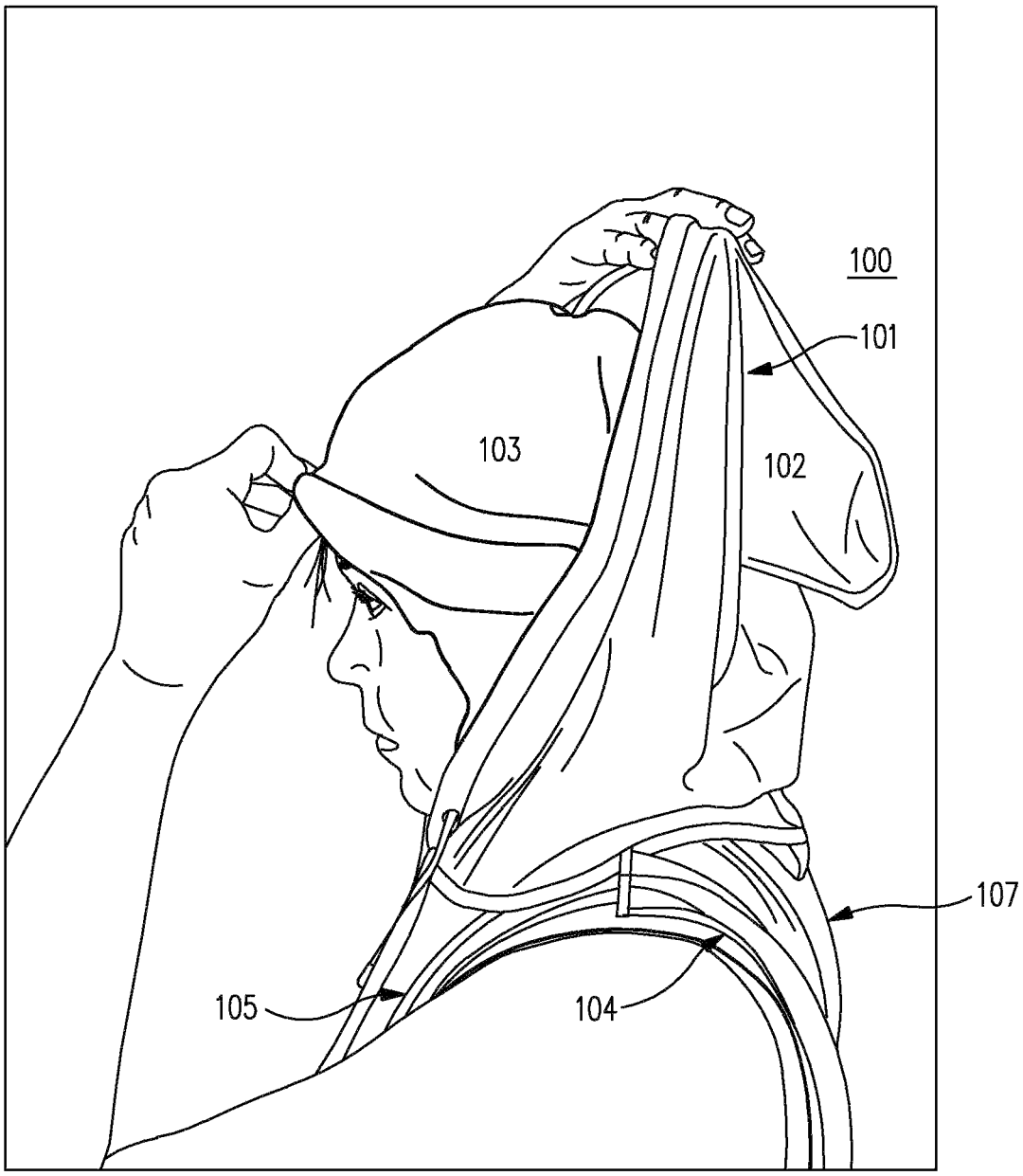
FIG. 5 shows a left-side view of one embodiment of a disclosed garment with two-layered hood including a two-layered hood with an outer hood layer and absorbent inner hood layer and showing the use of attachment mechanisms to removably detach the disclosed absorbent inner hood layer from the outer hood layer exposing the absorbent inner hood layer.

FIG. 5 shows a left-side view of one embodiment of a disclosed garment with two-layered hood 100 with parent garment front 105 and parent garment back 107, and two-layered hood 101 with outer hood layer 102 and absorbent inner hood layer 103. FIG. 5 also shows the use of attachment mechanisms (not visible in FIG. 5 but shown in FIGS. 9, 10A and 10B) to removably attach the absorbent inner hood layer 103 to the outer hood layer 102. FIG. 5 further shows parent garment 104 and two-layered hood 101 with outer hood layer 102 partially detached from absorbent inner hood layer 103 and outer hood layer 102 pulled back exposing part of absorbent inner hood layer 103.

Figure 6:
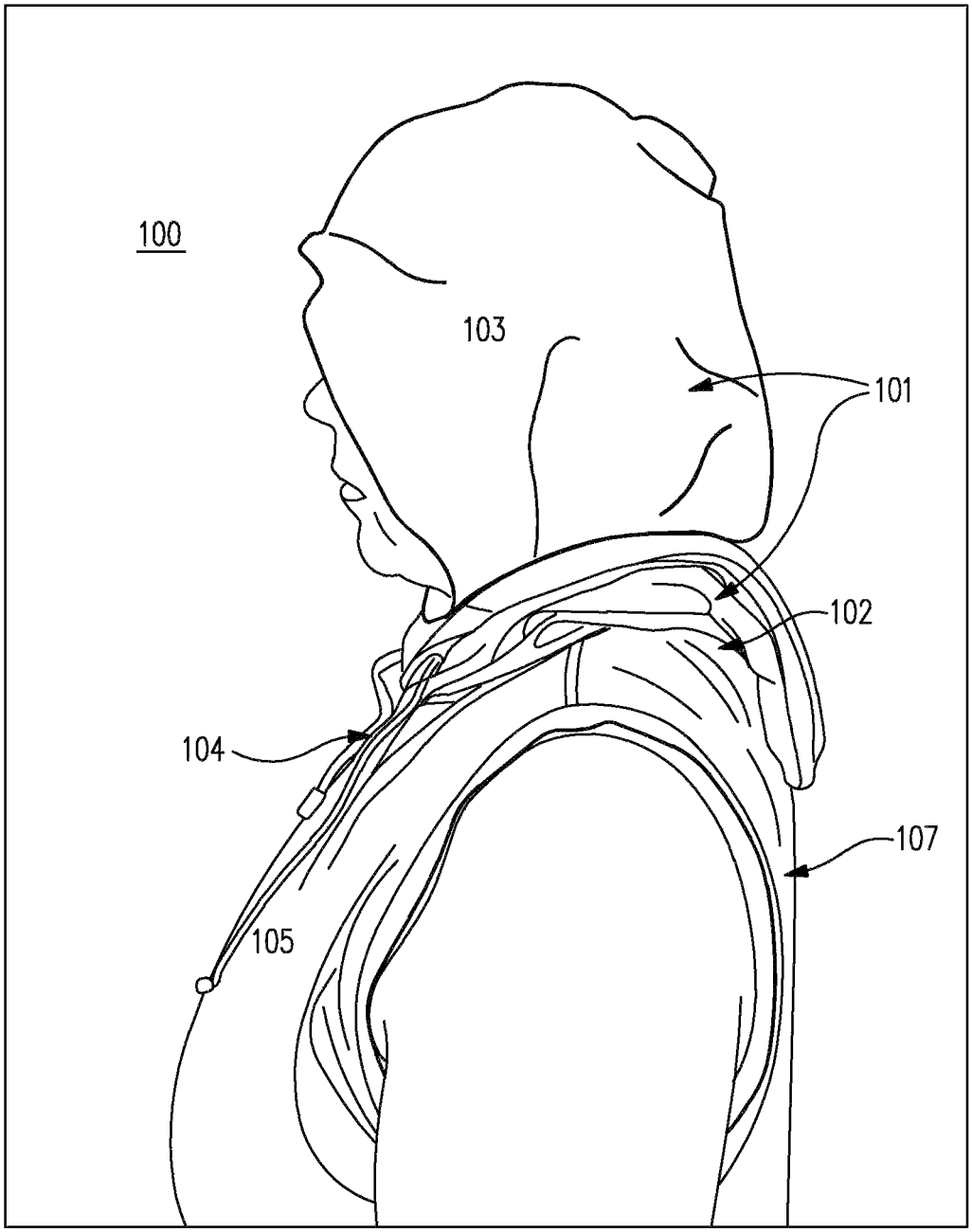
FIG. 6 shows a left-side view of one embodiment of a disclosed garment with two-layered hood including a two-layered hood with the outer hood layer partially detached from the disclosed absorbent inner hood layer and pulled back exposing the absorbent inner hood layer.

FIG. 6 shows a left-side view of one embodiment of a disclosed garment with two-layered hood 100 including parent garment 104 with parent garment front 105 and parent garment back 107, two-layered hood 101 with the outer hood layer 102 partially detached from the disclosed absorbent inner hood layer 103 and outer hood layer 102 pulled back exposing the disclosed absorbent inner hood layer 103.

Figure 7:
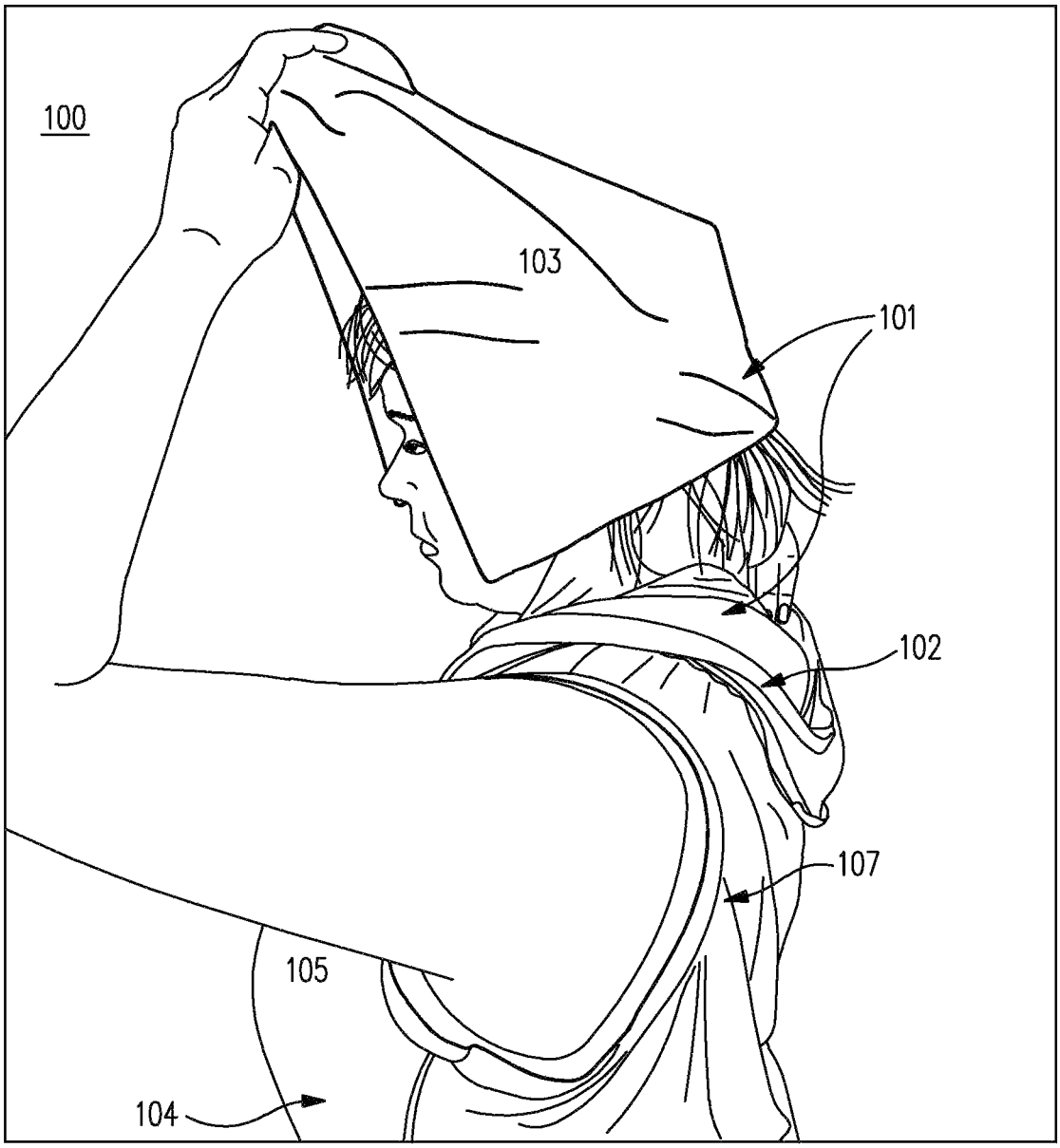
FIG. 7 shows a left-side view of one embodiment of a disclosed garment with two-layered hood including a two-layered hood with the outer hood layer detached from the disclosed absorbent inner hood layer and pulled back exposing the absorbent inner hood layer and with the absorbent inner hood layer being detached from the disclosed garment with two-layered hood.

FIG. 7 shows a left-side view of one embodiment of a disclosed garment with two-layered hood 100 including parent garment 104 with parent garment front 105 and parent garment back 107, two-layered hood 101 with outer hood layer 102 detached from the disclosed absorbent inner hood layer 103 and outer hood layer 102 pulled back exposing the entire absorbent inner hood layer 103 and with absorbent inner hood layer 103 in the process of being detached from the disclosed garment with two-layered hood 100.

Figure 8:
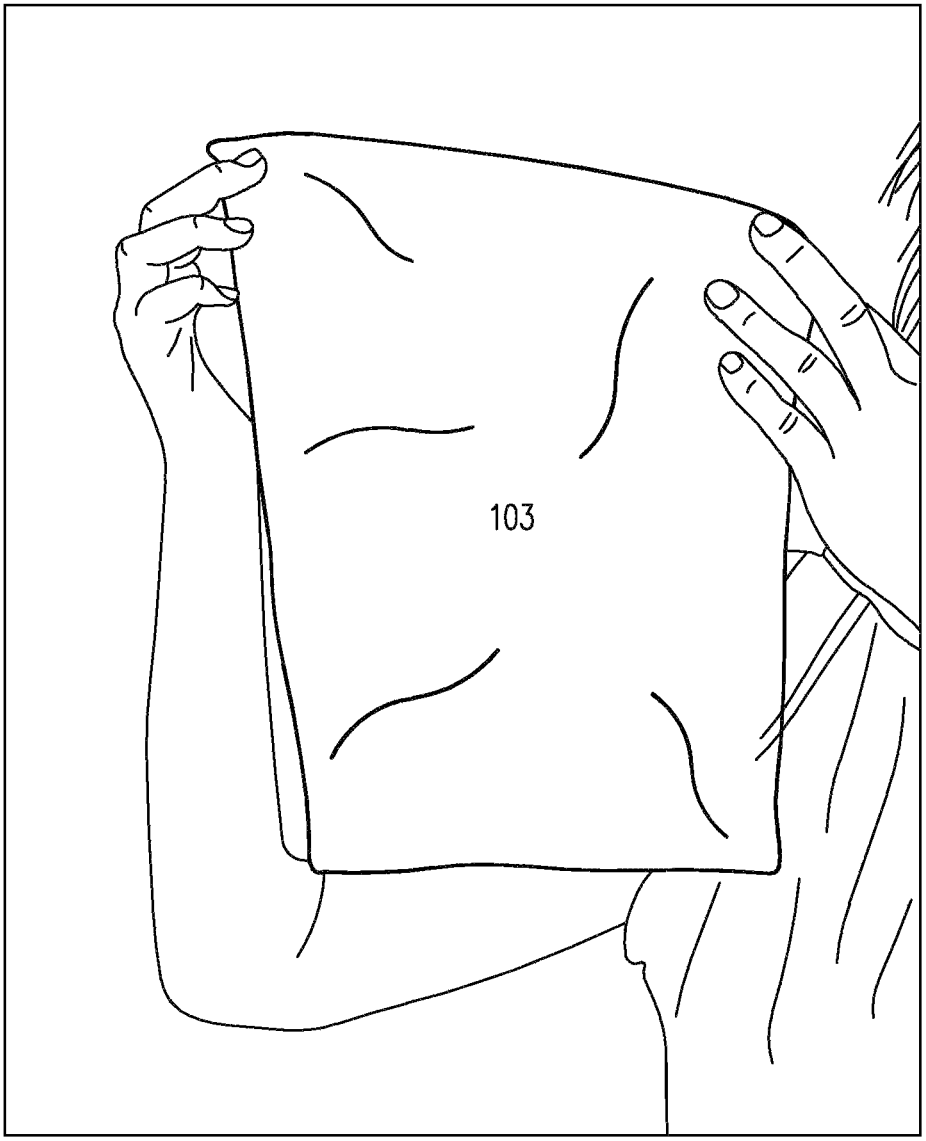
FIG. 8 shows a disclosed absorbent inner hood layer fully detached from a parent garment in accordance with one embodiment.

FIG. 8 shows the disclosed absorbent inner hood layer 103 of the disclosed embodiment of a garment with two-layered hood 100 fully detached so that disclosed absorbent inner hood layer 103 can be exchanged or used as a towel in accordance with one embodiment and/or washed separately from garment with two-layered hood 100.

As shown in FIGS. 1 through 8, in one embodiment, the disclosed garment with two-layered hood 100 includes a two-layered hood 101 designed such that the entire two-layered hood 101, i.e., both absorbent inner hood layer 103 and outer hood layer 102 can be worn over wearer's head or pulled back and draped over the wearer's back like a traditional hooded garment, or "hoodie." However, as discussed below, in one embodiment, the outer hood layer 102 of the two-layered hood 101 can be separately pulled back such that the absorbent inner hood layer 103 remains on the wearer's head while the outer hood layer 102 is pulled back and draped over parent garment back 107 and the wearer's back.

In this way perspiration can be absorbed by the absorbent inner hood layer 103 while the outer hood layer 102 remains essentially "sweat free." Then, after the workout, or other perspiration inducing action, the absorbent inner hood layer 103 can be removed, along with the absorbed perspiration, while the perspiration free outer hood layer 102 can be used like any other hood. The absorbent inner hood layer 103 can be washed to remove the absorbed perspiration, without having to wash the entire parent garment 104. The now clean absorbent inner hood layer 103 can then be reattached to the outer hood layer 102, and the garment with two-layered hood 100, to be carried around continuously to await the next perspiration inducing activity.

In addition, in one embodiment, the absorbent inner hood layer 103 of the disclosed two-layered hood 101 can be removed before, or during, the perspiration producing physical activity and used as a supplementary towel. In this case, the perspiration can be absorbed by the absorbent inner hood layer 103, now being used as a towel, while the outer hood layer 102 remains essentially "sweat free." Then, after the workout, or other perspiration inducing action, the absorbent inner hood layer 103, along with the absorbed perspiration, can be washed to remove the absorbed perspiration, without having to wash the entire parent garment 104. The now clean absorbent inner hood layer 103 can then be reattached to the outer hood layer 102, and the parent garment 104, to be carried around continuously, and without forethought, to await the next perspiration inducing activity.

As noted above, in various embodiments, the disclosed absorbent inner hood layer 103 is removably attached to outer hood layer 102. Consequently, in some embodiments, the disclosed absorbent inner hood layer 103 can be removably attached to, and used with, existing parent garments by simply adding attachment mechanisms to the existing parent garments.

In various embodiments the attachment mechanisms can be any attachment mechanism as discussed herein, and/or as known or available in the art at the time of filing, or as becomes available or known in the art after the time of filing. As specific examples the attachment mechanisms used to attach the disclosed absorbent inner hood layer 103 to outer hood layer 102 can be, but are not limited to: hooks, snaps, ropes, thread, elastic, strapping, zippers, buttons, sticky tabs, hook and loop attachment mechanisms, magnets, or any other temporary attachment mechanisms known in the art at the time of filing or as developed/made available after the time of filing that can be used to removably attach absorbent inner hood layer 103 to outer hood layer 102.

Figure 9:
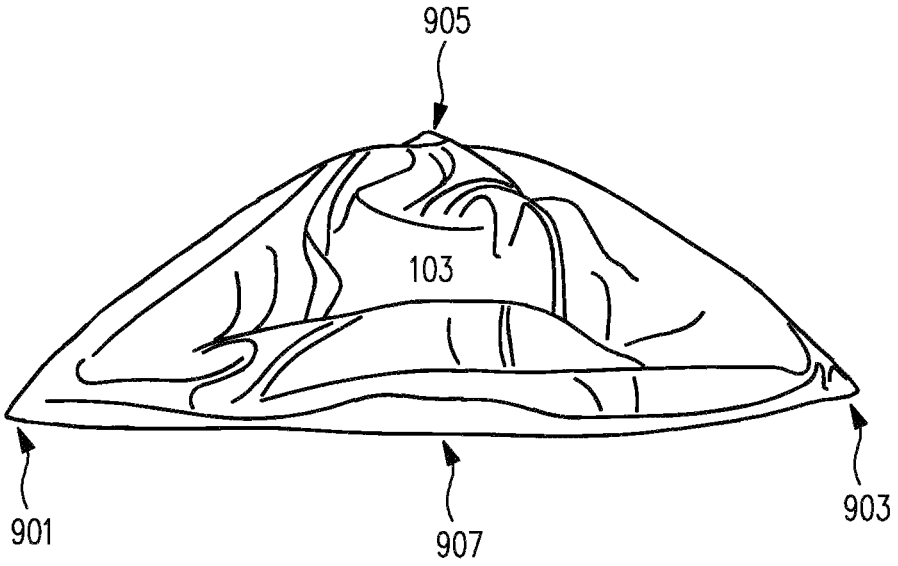
FIG. 9 shows the disclosed absorbent inner hood layer and the placement of attachment devices within absorbent inner hood layer in accordance with one embodiment.

FIG. 9 shows the disclosed absorbent inner hood layer 103 and the placement of attachments devices within absorbent inner hood layer 103 in accordance with one embodiment. As seen in FIG. 9, attachments mechanisms including, but not limited to, hooks, snaps, ropes, thread, elastic, strapping, zippers, buttons, sticky tabs, hook and loop attachment mechanisms, magnets are positioned in four locations: one at each bottom corner 901 and 903; one at front or top position 905, and one at bottom center position 907. As discussed in more detail below, in accordance with this specific example, corresponding attachment mechanisms can also be placed in outer hood layer 102.

Referring to FIGS. 1, 2, 3, 4, 8 and 9 together, absorbent inner hood layer 103 designed such that the entire two-layered hood 101, i.e., both absorbent inner hood layer 103 and outer hood layer 102 can be worn over wearer's head like a traditional hooded garment, or "hoodie." However, as discussed below, in one embodiment, the outer hood layer 102 of the two-layered hood 101 can be separately pulled back such that the absorbent inner hood layer 103 remains on the wearer's head while the outer hood layer 102 is pulled back and draped over the wearer's back.

In this way perspiration can be absorbed by the absorbent inner hood layer 103 while the outer hood layer 102 remains essentially "sweat free." Then, after the workout, or other perspiration inducing action, the absorbent inner hood layer 103 can be removed, along with the absorbed perspiration, while the perspiration free outer hood layer 102 can be used like any other garment hood. The absorbent inner hood layer 103 can then be washed to remove the absorbed perspiration, without having to wash the entire parent garment 104. The now clean absorbent inner hood layer 103 can then be reattached to the outer hood layer 102, and the parent garment 104 garment, to be carried around continuously to await the next perspiration inducing activity.

In some embodiments, two or more of the disclosed absorbent inner hood layers 103 are utilized. In these embodiments, when a first disclosed absorbent inner hood layer 103 becomes soiled the first disclosed absorbent inner hood layer 103 can be detached from the disclosed garment with two-layered hood 100 and replaced with a second disclosed absorbent inner hood layer 103. In this way, the amount of perspiration capable of being absorbed is effectively doubled. In addition, by utilizing multiple disclosed absorbent inner hood layers 103, the user can wait multiple days before having to wash the disclosed absorbent inner hood layers 103. This provides the user the flexibility and freedom to minimize complications to their daily routine.

By making absorbent inner hood layer 103 removable using various temporary attachment mechanisms, in various embodiments, the disclosed absorbent inner hood layer 103 is can removably attached to an outer hood layer 102 of any garment having a hood. Consequently, in some embodiments, the disclosed absorbent inner hood layer 103 can be removably attached to, and used with, existing parent garments by simply adding attachment mechanisms to the existing parent garments.

Figure 10A:
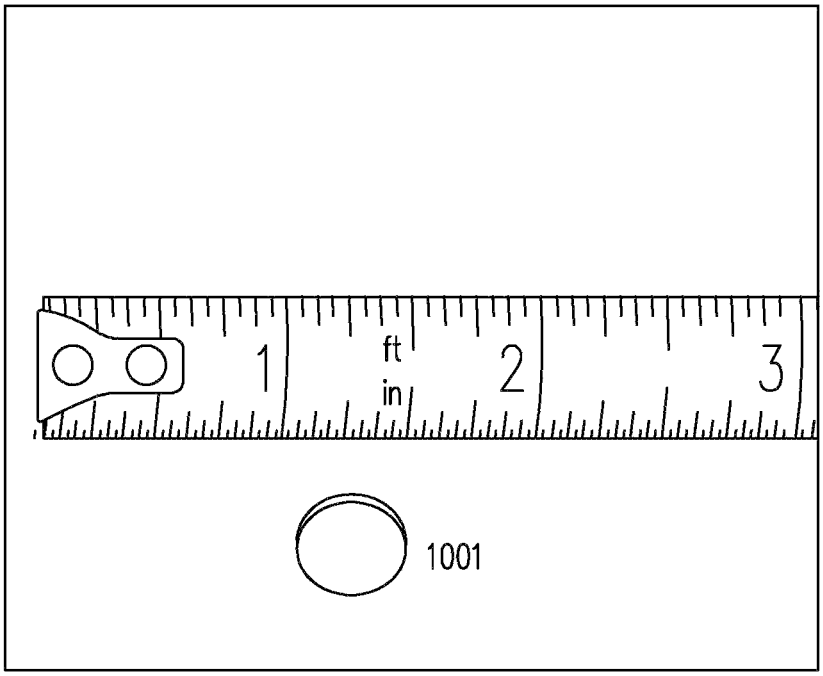
FIG. 10A shows one embodiment of an attachment mechanism, in this specific illustrative example, a magnet, used to removably attach the disclosed absorbent inner hood layer to an outer hood layer.

In one specific illustrative example of one embodiment, the attachment mechanisms are magnets. FIG. 10A shows one illustrative embodiment of an attachment mechanism, in this specific illustrative example a magnet 1001, used to removably attach the absorbent inner hood layer 103 to the outer hood layer 102.

Figure 10B:
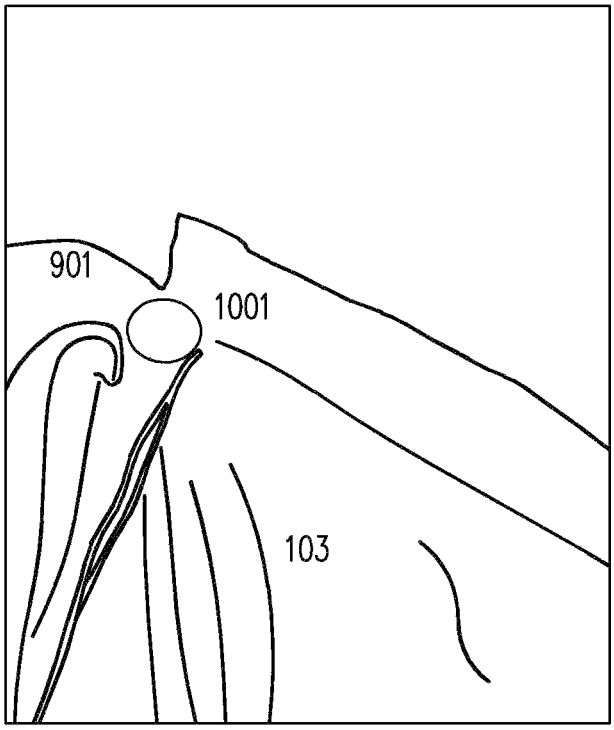
FIG. 10B shows an attachment device, in this specific example a magnet, attached to a bottom corner of the absorbent inner hood layer in accordance with one embodiment.

FIG. 10B shows a magnet 1001 attached to bottom corner 901 of absorbent inner hood layer 103. In various embodiments, magnet 1001 can be attached with an adhesive, tread, hook and loops systems, sewn into the absorbent inner hood layer 103 or any other means of attaching magnet 1001 to absorbent inner hood layer 103 as discussed herein, and/or as known in the art at the time of filing, and/or as becomes known/available in the art after the time of filing.

In one embodiment, once absorbent inner hood layer 103, including attachment mechanisms, is created, corresponding attachment devices, i.e., corresponding hooks, snaps, ropes, thread, elastic, strapping, zippers, buttons, sticky tabs, hook and loop attachment mechanisms, magnets, or any other temporary attachment mechanisms known in the art at the time of filing or as developed/made available after the time of filing, must be placed in outer hood layer 102 for removably attaching absorbent inner hood layer 103 to outer hood layer 102 and parent garment 104. In accordance with the specific example of FIGS. 10A and 10B where the attachment mechanisms are magnets, the corresponding attachment mechanisms are oppositely polarized magnets that must be placed in outer hood layer 102.

As noted above, by making absorbent inner hood layer 103 removable using various temporary attachment mechanisms, in various embodiments, the disclosed absorbent inner hood layer 103 is can removably attached to an outer hood layer 102 of any garment having a hood. Consequently, in some embodiments, the disclosed absorbent inner hood layer 103 can be removably attached to, and used with, existing parent garments by simply adding attachment mechanisms to the existing parent garments.

As noted above, one attachment mechanism can be the magnets of FIGS. 10A and 10B. In one embodiment, the magnets are sewn or sealed into both outer hood layer 102 and absorbent inner hood layer 103.

Figure 11:
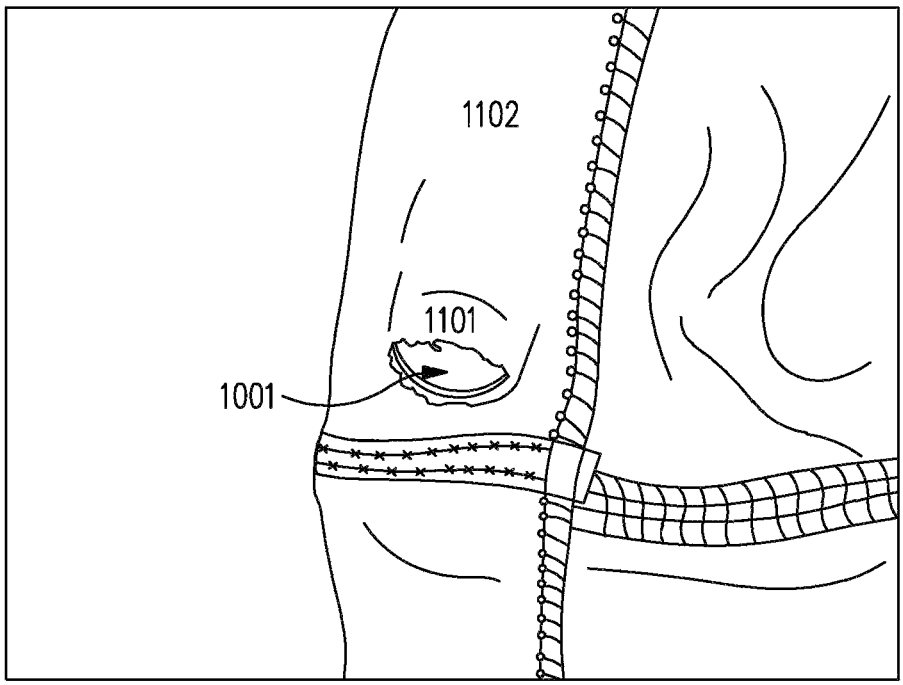
FIG. 11 shows a slit cut into an outer hood layer so that an attachment device, in this illustrative example a magnet, can be inserted into the outer hood layer in accordance with one embodiment.

FIG. 11 shows a slit 1101 cut into outer hood layer 102 of a parent garment 1102 so that a magnet 1001 can be inserted into outer hood layer 102. In this specific illustrative example, slit 1101 is cut to a length of ⅜ inch on an edge of outer hood layer 102. Recall from the discussion above with respect to FIG. 9, in this specific illustrative example magnets 1001 were positioned in four locations: one at each bottom corner 901 and 903; one at front or top position 905, and one at bottom center position 907 of absorbent inner hood layer 103. Consequently, four corresponding magnets must be placed in outer hood layer 102; one at each bottom corner; one at the front or top position; and one at the bottom center position of outer hood layer 102. To this end, in one embodiment, four slits, like slit 1101 must be made at these locations in outer hood layer 102 and magnets 1001 inserted. In one embodiment, once the magnets 1001 are inserted in slits 1201, glue is applied, and the slits 1101 are closed with the magnets 1001 glue in place and enclosed in the now sealed slits.

Figure 12:
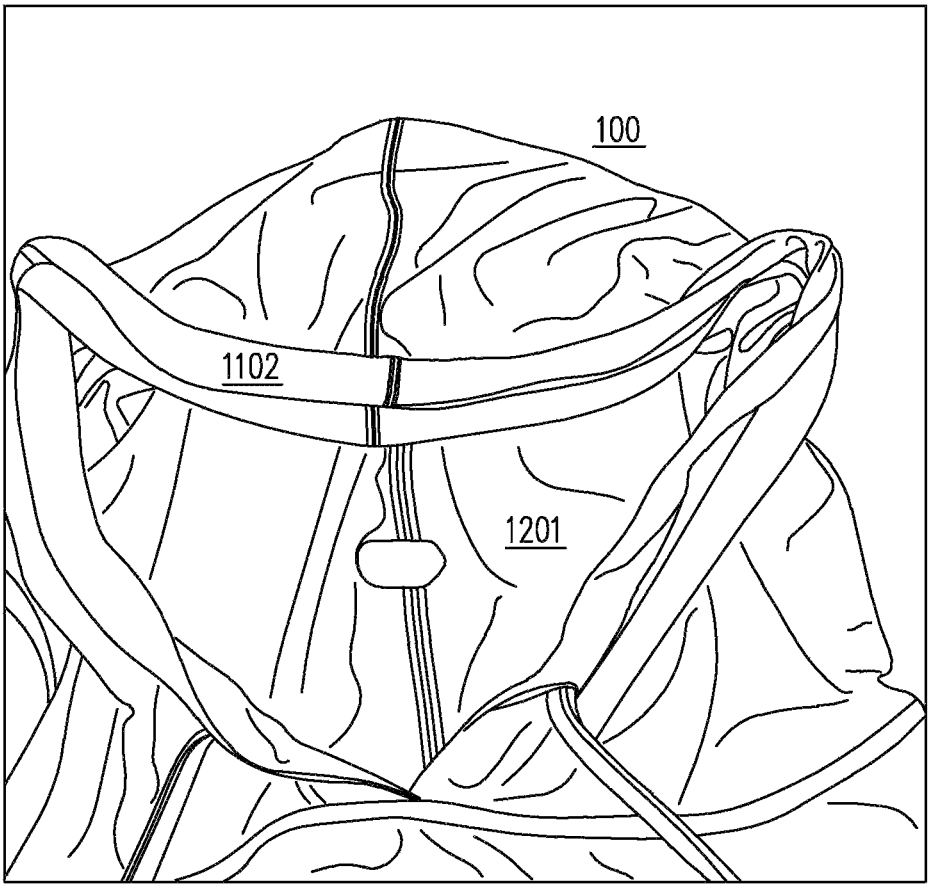
FIG. 12 shows a sealed bottom center position magnet and slit in an outer hood layer in accordance with one embodiment.

FIG. 12 shows a sealed bottom center position magnet and slit 1201 in outer hood layer 102 of parent garment 1102.

Figure 13:
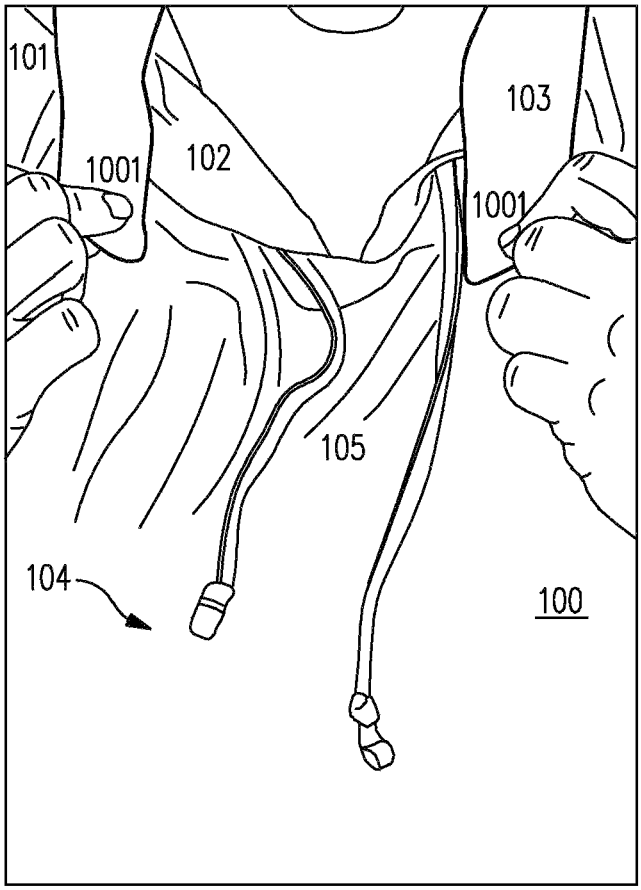
FIG. 13 shows a front view of one embodiment of a disclosed garment with two-layered hood including an outer hood layer and disclosed absorbent inner hood layer and two bottom corner attachment mechanisms.

FIG. 13 shows a front view of one embodiment of a disclosed garment with two-layered hood 100 including parent garment 104 and two-layered hood 101 with outer hood layer 102 and absorbent inner hood layer 103 and two bottom corner attachment magnets 1001.

Figure 14:
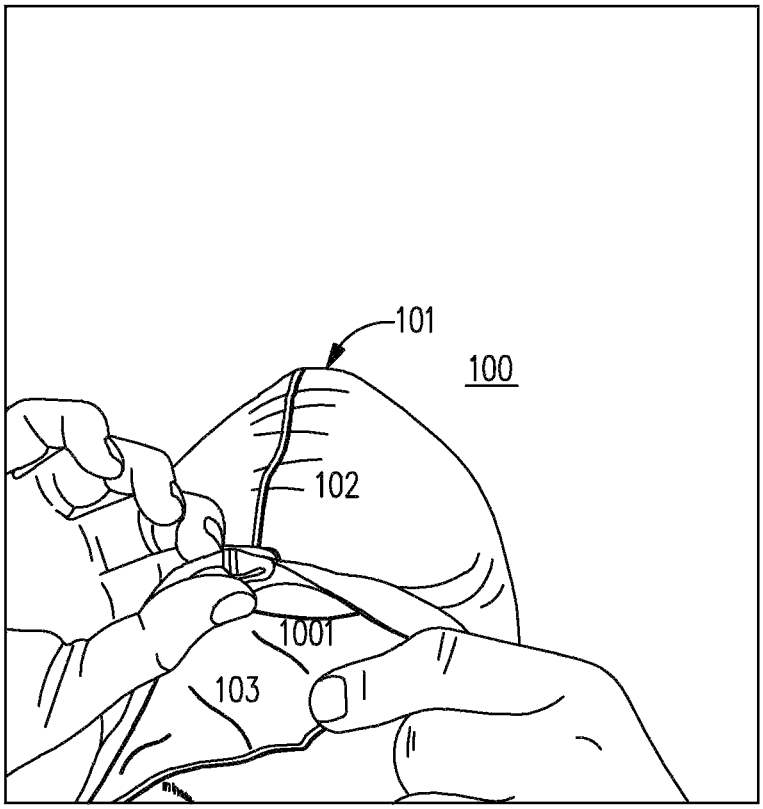
FIG. 14 shows a front view of one embodiment of a disclosed garment with two-layered hood including an outer hood layer and disclosed absorbent inner hood layer and a front or top position attachment mechanism.

FIG. 14 shows a front view of one embodiment of a disclosed garment with two-layered hood 100 including a two-layered hood 101 with outer hood layer 102 and absorbent inner hood layer 103 and a front or top position attachment magnet 1001.

As discussed above, embodiments of the present disclosure provide a technical solution to the long-standing technical problem of providing physical activity related attire, e.g., athletic, work, and/or personal attire, with a supplementary absorbent mechanism that is part of the physical activity related attire, yet does not suffer from the inconvenience, aesthetic, hygiene, and health issues associated with prior art methods and systems.

As discussed above, in one embodiment, an absorbent inner hood layer made of absorbent or wicking material such as terrycloth, microfiber, or any other absorbent towel-like material is disclosed. In one embodiment, the absorbent inner hood layer is formed to substantially line an inner surface of a parent garment hood and be detachable from the inner surface of the parent garment hood.

When the disclosed absorbent inner hood layer is removable attached as an inner layer to a parent garment hood to form a two-layer hood, the entire two-layer hood, i.e., both inner and outer hood layers, can be worn over wearer's head or pulled back and draped over the wearer's back like a traditional hooded garment, or "hoodie." However, in one embodiment, the outer hood layer of the two-layer hood can be partially detached and separately pulled back such that the absorbent inner hood layer remains on the wearer's head while the outer hood layer is pulled back and draped over the wearer's back. In this way perspiration can be absorbed by the absorbent inner hood layer while the outer hood layer remains essentially "sweat free."

Then, after the workout, or other perspiration inducing action, the absorbent inner hood layer can be removed, along with the absorbed perspiration, while the perspiration free outer hood layer can be used like any other hood. The absorbent inner hood layer can then be washed to remove the absorbed perspiration, without having to wash the entire garment. In addition, in one embodiment, a second absorbent inner hood layer can be used to immediately replace the soiled first absorbent inner hood layer. Either way a clean absorbent inner hood layer can then be attached to the outer hood layer, and the parent garment, to await the next perspiration inducing activity.

Using the disclosed detachable absorbent inner hood layer, a mechanism is provided to absorb, control, and remove perspiration while, at the same time preserving the popular aesthetics of a standard hooded garment such as a hoodie.

In addition, in one embodiment, the disclosed absorbent inner hood layer can be removed before, or during, the perspiration producing physical activity and used as a supplementary towel. In this case, the perspiration can be absorbed by the absorbent inner hood layer, now being used as a towel, while the outer hood layer remains essentially "sweat free." Then, after the workout, or other perspiration inducing action, the absorbent inner hood layer, along with the absorbed perspiration, can then be washed to remove the absorbed perspiration, without having to wash the entire garment. The now clean absorbent inner hood layer can then be reattached to the outer hood layer, and the parent garment, to be carried around continuously, and without forethought, to await the next perspiration inducing activity.

In addition, when two or more of the disclosed absorbent inner hood layers are utilized, when a first disclosed absorbent inner hood layer becomes soiled the first disclosed absorbent inner hood layer can be detached from the parent garment and replaced with a second disclosed absorbent inner hood layer. In this way, the amount of perspiration capable of being absorbed is effectively doubled. In addition, by utilizing multiple disclosed absorbent inner hood layers, the user can wait multiple days before having to wash the disclosed absorbent inner hood layers. This provides the user the flexibility and freedom to minimize complications to their daily routine.

The disclosed embodiments provide a supplementary absorbent mechanism that is a removable part of the parent garment and yet does not suffer from the inconvenience, aesthetic issues, hygiene issues, and health issues associated with prior art methods and systems. In addition, the disclosed embodiments provide these advantages in the hooded garment, or "hoodie," platform that has become so popular with people of all ages.

A wearer of a garment including the disclosed absorbent inner hood layer is provided a perspiration absorbing mechanism/device that can be used to protect both the wearer and parent garment from perspiration, and/or be used as a supplementary towel like device; without requiring the wearer to remember to bring any additional items. In short, whenever the disclosed absorbent inner hood layers are worn with a parent garment, the wearer always has a towel like absorbent mechanism with them.

Consequently, the disclosed absorbent inner hood layer provides a solution to one of the long-standing challenges facing both fitness enthusiasts and physical activity related attire manufacturers of needing to provide physical activity related attire that addresses the issues of perspiration and personal hygiene. However, the disclosed absorbent inner hood layer can also be used in the workplace, or in any other circumstances where physical activity is likely, and/or perspiration is likely to be induced. This can include, but is not limited to, any casual wear, camping gear, uniforms, work clothes, etc.

In addition, unlike prior art methods and systems, the disclosed absorbent inner hood layer does not leave perspiration-soaked garment in contact with the wearer's skin by remaining in the physical activity related attire. Instead, the disclosed absorbent inner hood layer provides an absorption mechanism that once used to protect the parent garment is detachable from the parent garment. Consequently, using the disclosed absorbent inner hood layer the perspiration is removed from the user and the parent garment so that the heath, hygiene, and other issues associated with walking around in a sweat soaked garment are eliminated.

The disclosed solution is particularly convenient when the wearer is sharing a workout facility such as a gym, dojo, game court/arena, workplace, etc. with others. In these venues, the buildup of perspiration in, or on, clothing and sweat dripping onto machines, weights, floors and other shared equipment and spaces is completely avoided without having to resort to potentially unsanitary supplementary towels or other absorbent items provided by persons and facilities unknown. This is particularly important given the current elevated disease consciousness and routine world travel.

Finally, by providing a detachable absorbent inner hood layer that can be removed before, or during, the perspiration producing physical activity, the perspiration can be absorbed by the absorbent inner hood layer while the outer hood layer and parent garment remains essentially "sweat free." Consequently, after the workout, or other perspiration inducing action, the absorbent inner hood layer, along with the absorbed perspiration, can then be washed to remove the absorbed perspiration, without having to wash the entire garment. Therefore, less clothing needs to be washed and energy and washing resources are saved.

As discussed above, in one embodiment, a garment is disclosed that includes a two-layer hood. The two-layer hood of the disclosed embodiments includes an outer hood layer, typically made of the same material as the garment itself, and a detachable absorbent inner hood layer that is formed to substantially line an inner surface of the two-layer hood and that is made of absorbent material.

Consequently, in one embodiment, the disclosed garment includes a two-layer hood designed such that the entire hood, i.e., both inner and outer hood layers, can be worn over wearer's head or pulled back and draped over the wearer's back like a traditional hooded garment, or "hoodie." However, in one embodiment, the outer hood layer of the two-layer hood can be separately pulled back such that the absorbent inner hood layer remains on the wearer's head while the outer hood layer is pulled back and draped over the wearer's back. In this way perspiration can be absorbed by the absorbent inner hood layer while the outer hood layer remains essentially "sweat free." Then, after the workout, or other perspiration inducing action, the absorbent inner hood layer can be removed, along with the absorbed perspiration, while the perspiration free outer hood layer can be used like any other hood. The absorbent inner hood layer can then be washed to remove the absorbed perspiration, without having to wash the entire garment. The now clean absorbent inner hood layer can then be reattached to the outer hood layer, and the garment, to be carried around continuously to await the next perspiration inducing activity.

Using the disclosed two-layer hood garment including the disclosed detachable absorbent inner hood layer, a mechanism is provided to absorb, control, and remove perspiration while, at the same time preserving the popular aesthetics of a standard hooded garment such as a hoodie.

In addition, in one embodiment, the absorbent inner hood layer of the disclosed two-layer hood can be removed before, or during, the perspiration producing physical activity and used as a supplementary towel. In this case, the perspiration can be absorbed by the absorbent inner hood layer, now being used as a towel, while the outer hood layer remains essentially "sweat free." Then, after the workout, or other perspiration inducing action, the absorbent inner hood layer, along with the absorbed perspiration, can then be washed to remove the absorbed perspiration, without having to wash the entire garment. The now clean absorbent inner hood layer can then be reattached to the outer hood layer, and the garment, to be carried around continuously, and without forethought, to await the next perspiration inducing activity.

In addition, when two or more of the disclosed absorbent inner hood layers are utilized with the disclosed two-layered hood garment, when a first disclosed absorbent inner hood layer becomes soiled the first disclosed absorbent inner hood layer can be detached from the parent garment and replaced with a second disclosed absorbent inner hood layer. In this way, the amount of perspiration capable of being absorbed is effectively doubled. In addition, by utilizing multiple disclosed absorbent inner hood layers, the user can wait multiple days before having to wash the disclosed absorbent inner hood layers. This provides the user the flexibility and freedom to minimize complications to their daily routine.

The disclosed embodiments provide a garment that includes supplementary absorbent mechanism that is part of the garment and yet does not suffer from the inconvenience, hygiene issues, and health issues associated with prior art methods and systems. In addition, the disclosed embodiments provide these advantages in the hooded garment, or "hoodie," platform that has become so popular with people of all ages.

A wearer of the disclosed garments with two-layered hoods is provided a perspiration absorbing mechanism/device that can be used to protect both the wearer and parent garment from perspiration, and/or be used as a supplementary towel like device; without requiring the wearer to remember to bring any additional items. In short, whenever the disclosed garments with two-layered hoods are worn, the wearer always has a towel like absorbent mechanism with them.

Consequently, disclosed garments with two-layered hoods provide a solution to one of the long-standing challenges facing both fitness enthusiasts and physical activity related attire manufacturers of needing to provide physical activity related attire that addresses the issues of perspiration and personal hygiene. However, the disclosed garments with two-layered hoods can also be used in the workplace, or in any other circumstances where physical activity is likely, and/or perspiration is likely to be induced. This can include, but is not limited to, any casual wear, camping gear, uniforms, work clothes, etc.

In addition, unlike prior art methods and systems, the disclosed garments with two-layered hoods do not use absorbing materials to draw perspiration away from the wearer's skin where the perspiration then remains in the physical activity related attire and in contact with the wearer. Instead, the disclosed garments with two-layered hoods provide an absorption mechanism, i.e., the absorbent inner hood layer, that once used to protect the parent garment is detachable from the parent garment. Consequently, using the disclosed garments with two-layered hoods the perspiration is removed from the user and the parent garment so that the heath, hygiene, and other issues associated with walking around in a sweat soaked garment are eliminated.

The disclosed solution is particularly convenient when the wearer is sharing a workout facility such as a gym, dojo, game court/arena, workplace etc. with others. In these venues, the buildup of perspiration in, or on, clothing and sweat dripping onto machines, weights, floors and other shared equipment and spaces is completely avoided without having to resort to potentially unsanitary supplementary towels or other absorbent items provided by persons and facilities unknown. This is particularly important given the current elevated disease consciousness and routine world travel.

Finally, by providing a detachable absorbent inner hood layer that can be removed before, or during, the perspiration producing physical activity, the perspiration can be absorbed by the absorbent inner hood layer while the outer hood layer and parent garment remains essentially "sweat free." Consequently, after the workout, or other perspiration inducing action, the absorbent inner hood layer, along with the absorbed perspiration, can then be washed to remove the absorbed perspiration, without having to wash the entire garment. Therefore, using the disclosed garments with two-layered hoods, less clothing needs to be washed and energy and washing resources are saved.

In one embodiment, a hooded garment includes a parent garment with an outer hood layer permanently attached to the parent garment and an absorbent inner hood layer. In one embodiment, the absorbent inner hood layer is removably attached to the outer hood layer such that the absorbent inner hood layer forms a removable absorbent lining for the outer hood layer on at least part of an inner surface of the outer hood layer.

In one embodiment, the parent garment is athletic activity attire. In one embodiment, the parent garment is work related attire. In one embodiment, the parent garment is personal attire. In one embodiment, the parent garment is a hooded sweatshirt.

In one embodiment, the absorbent inner hood layer is removably attached to the outer hood layer using one or more attachment mechanisms. In one embodiment, the one or more attachment mechanisms each has a first attachment mechanism component that is part of the absorbent inner hood layer and a corresponding second attachment mechanism component that is part of the outer hood layer.

In one embodiment, the one or more attachment mechanisms are magnets. In one embodiment, the one or more attachment mechanisms are hook and loop systems. In one embodiment, the one or more attachment mechanisms are hooks. In one embodiment, the one or more attachment mechanisms are snaps. In one embodiment, the one or more attachment mechanisms are ropes. In one embodiment, the one or more attachment mechanisms are thread. In one embodiment, the one or more attachment mechanisms are elastic. In one embodiment, the one or more attachment mechanisms are strapping. In one embodiment, the one or more attachment mechanisms are zippers. In one embodiment, the one or more attachment mechanisms are buttons. In one embodiment, the one or more attachment mechanisms are sticky tabs.

In one embodiment, a garment hood includes an outer hood layer and an absorbent inner hood layer. In one embodiment, the absorbent inner hood layer is removably attached to the outer hood layer such that the absorbent inner hood layer forms a removable absorbent lining for the outer hood layer on at least part of an inner surface of the outer hood layer.

In one embodiment, the absorbent inner hood layer is removably attached to the outer hood layer using one or more attachment mechanisms. In one embodiment, the one or more attachment mechanisms each have a first attachment mechanism component that is part of the absorbent inner hood layer and a corresponding second attachment mechanism component that is part of the outer hood layer.

In one embodiment, the one or more attachment mechanisms are magnets. In one embodiment, the one or more attachment mechanisms are hook and loop systems. In one embodiment, the one or more attachment mechanisms are hooks. In one embodiment, the one or more attachment mechanisms are snaps. In one embodiment, the one or more attachment mechanisms are ropes. In one embodiment, the one or more attachment mechanisms are thread. In one embodiment, the one or more attachment mechanisms are elastic. In one embodiment, the one or more attachment mechanisms are strapping. In one embodiment, the one or more attachment mechanisms are zippers. In one embodiment, the one or more attachment mechanisms are buttons. In one embodiment, the one or more attachment mechanisms are sticky tabs.

In one embodiment, a garment hood is used with a parent garment. In one embodiment, the parent garment is athletic activity attire. In one embodiment, the parent garment is work related attire. In one embodiment, the parent garment is personal attire. In one embodiment, the parent garment is a hooded sweatshirt.

In one embodiment, a detachable absorbent inner hood layer is disclosed that is capable of being removably attached to an inner surface of garment hood such that the absorbent inner hood layer forms a removable absorbent lining for the garment on at least part of an inner surface of the garment hood.

In one embodiment, the detachable absorbent inner hood layer is capable of being removably attached to an outer hood layer of a parent garment using one or more attachment mechanisms. In one embodiment, the one or more attachment mechanisms each have a first attachment mechanism component that is part of the detachable absorbent inner hood layer and a corresponding second attachment mechanism component that is part of the outer hood layer.

In one embodiment, the one or more attachment mechanisms are magnets. In one embodiment, the one or more attachment mechanisms are hook and loop systems. In one embodiment, the one or more attachment mechanisms are hooks. In one embodiment, the one or more attachment mechanisms are snaps. In one embodiment, the one or more attachment mechanisms are ropes. In one embodiment, the one or more attachment mechanisms are thread. In one embodiment, the one or more attachment mechanisms are elastic. In one embodiment, the one or more attachment mechanisms are strapping. In one embodiment, the one or more attachment mechanisms are zippers. In one embodiment, the one or more attachment mechanisms are buttons. In one embodiment, the one or more attachment mechanisms are sticky tabs.

In one embodiment, the detachable absorbent inner hood layer is used with a parent garment. In one embodiment, the parent garment is athletic activity attire. In one embodiment, the parent garment is work related attire. In one embodiment, the parent garment is personal attire. In one embodiment, the parent garment is a hooded sweatshirt.

The present invention has been described in particular detail with respect to specific possible embodiments. Those of skill in the art will appreciate that the invention may be practiced in other embodiments. For example, the nomenclature used for components, capitalization of component designations and terms, the attributes, or structural aspect is not significant, mandatory, or limiting, and the mechanisms that implement the invention or its features can have various different names. Also, particular divisions of functionality between the various components described herein are merely exemplary, and not mandatory or significant. Consequently, functions performed by a single component may, in other embodiments, be performed by multiple components, and functions performed by multiple components may, in other embodiments, be performed by a single component.

In addition, the operations and structures shown in the figures, or as discussed herein, are identified using a particular nomenclature for ease of description and understanding, but other nomenclature is often used in the art to identify equivalent operations.

Therefore, numerous variations, whether explicitly provided for by the specification or implied by the specification or not, may be implemented by one of skill in the art in view of this disclosure.

What is claimed is:

1. A hooded garment comprising:

a parent garment;

an outer hood layer permanently attached to the parent garment;

an absorbent inner hood layer, the absorbent inner hood layer being removably attached to the outer hood layer wherein:

when attached to the outer hood layer, the absorbent inner hood layer substantially lines an inner surface of the outer hood layer such that both the absorbent inner hood layer and the outer hood layer are capable of being pulled back together from a wearer's head and draped over the wearer's back; and when detached from the outer hood layer, the absorbent inner hood layer is capable of being used as a towel.

2. The hooded garment of claim 1 wherein the parent garment is athletic activity attire.

3. The hooded garment of claim 1 wherein the parent garment is work related attire.

4. The hooded garment of claim 1 wherein the parent garment is personal attire.

5. The hooded garment of claim 1 wherein the parent garment is a hooded sweatshirt.

6. The hooded garment of claim 1 wherein the absorbent inner hood layer is removably attached to the outer hood layer using one or more attachment mechanisms, the one or more attachment mechanisms each having a first attachment mechanism component that is part of the absorbent inner hood layer and a corresponding second attachment mechanism component that is part of the outer hood layer.

7. The hooded garment of claim 1 wherein the one or more attachment mechanisms are magnets.

8. The hooded garment of claim 1 wherein the one or more attachment mechanisms are hook and loop systems.

9. The hooded garment of claim 1 wherein the at least one of the one or more attachment mechanisms is selected from the group of more attachment mechanisms consisting of:

hooks;
snaps;
ropes;
thread;
elastic;
strapping;
zippers;
buttons; and
sticky tabs.

10. A garment hood comprising:

an outer hood layer;

an absorbent inner hood layer, the absorbent inner hood layer being removably attached to the outer hood layer wherein:

when attached to the outer hood layer, the absorbent inner hood layer substantially lines an inner surface of the outer hood layer such that both the absorbent inner hood layer and the outer hood layer are capable of being pulled back together from a wearer's head and draped over the wearer's back; and when detached from the outer hood layer, the absorbent inner hood layer is capable of being used as a towel.

11. The garment hood of claim 10 wherein the absorbent inner hood layer is removably attached to the outer hood layer using one or more attachment mechanisms, the one or more attachment mechanisms each having a first attachment mechanism component that is part of the absorbent inner hood layer and a corresponding second attachment mechanism component that is part of the outer hood layer.

12. The garment hood of claim 10 wherein the one or more attachment mechanisms are magnets.

13. The garment hood of claim 10 wherein the one or more attachment mechanisms are hook and loop systems.

14. The garment hood of claim 10 wherein the at least one of the one or more attachment mechanisms is selected from the group of more attachment mechanisms consisting of:

hooks;
snaps;
ropes;
thread;
elastic;
strapping;
zippers;
buttons; and
sticky tabs.

15. The garment hood of claim 10 wherein the garment hood is part of a parent garment that is a parent garment selected from the group of parent garments consisting of:

athletic activity attire;
work related attire;
personal attire; and
a hooded sweatshirt.

16. A detachable absorbent inner hood layer comprising:

an absorbent inner hood layer, the absorbent inner hood layer capable of being removably attached to an inner surface of a garment hood wherein:

when attached to the inner surface of the garment hood, the absorbent inner hood layer substantially lines the inner surface of the garment hood such that both the absorbent inner hood layer and the garment hood are capable of being pulled back together from a wearer's head and draped over the wearer's back; and when detached from the garment hood, the absorbent inner hood layer is capable of being used as a towel.

17. The detachable absorbent inner hood layer of claim 16 wherein the detachable absorbent inner hood layer is capable of being removably attached to an outer hood layer of a parent garment using one or more attachment mechanisms, the one or more attachment mechanisms each having a first attachment mechanism component that is part of the detachable absorbent inner hood layer and a corresponding second attachment mechanism component that is part of the outer hood layer.

18. The detachable absorbent inner hood layer of claim 17 wherein the one or more attachment mechanisms are magnets.

19. The detachable absorbent inner hood layer of claim 17 wherein the one or more attachment mechanisms are hook and loop systems.

20. The detachable absorbent inner hood layer of claim 17 wherein the at least one of the one or more attachment mechanisms are selected from the group of more attachment mechanisms consisting of:

hooks;
snaps;
ropes;
thread;
elastic;
strapping;
zippers;
buttons; and
sticky tabs.

* * * * *